United States Patent [19]

Clevely

[11] 4,385,928

[45] May 31, 1983

[54] AGGLOMERATION METHOD

[75] Inventor: Robert E. Clevely, Narvon, Pa.

[73] Assignee: Lukens, Inc., Coatesville, Pa.

[21] Appl. No.: 288,184

[22] Filed: Jul. 29, 1981

[51] Int. Cl.[3] ..... C22B 1/242

[52] U.S. Cl. ..... 75/3; 164/117; 23/313 R

[58] Field of Search ..... 75/3–5, 75/25; 164/111, 117; 23/313 R, 313 AS

[56] References Cited

U.S. PATENT DOCUMENTS

| | | | |
|---|---|---|---|
| 2,999,293 | 9/1961 | Taff et al. | 23/313 |
| 4,003,717 | 1/1977 | Cass et al. | 75/3 |
| 4,004,916 | 1/1977 | Kreiger | 75/3 |
| 4,162,286 | 7/1979 | Gunnell et al. | 264/117 |

FOREIGN PATENT DOCUMENTS

| | | | |
|---|---|---|---|
| 427994 | 1/1975 | U.S.S.R. | 75/3 |

*Primary Examiner*—Michael L. Lewis

*Attorney, Agent, or Firm*—James Albert Drobile

[57] ABSTRACT

Herein is disclosed a method for agglomerating finely-divided particulate material of the types found in flue dusts from electric steel-making furnaces and the like, comprising introducing the dry flue dust together with about 8 to 12 percent by weight of a suitable binder such as water into the inlet end of a screw conveying device so configured and operated as to provide for a retention time for the mixture of binder and particulate material in progressing from the inlet to the outlet of about 15 to 60 seconds.

3 Claims, 1 Drawing Figure

AGGLOMERATION METHOD

BACKGROUND OF THE INVENTION

1. Field of the Invention

This invention relates broadly to the agglomeration of finely-divided solid particulate material, and in particular is directed to a new and improved method for the agglomeration of certain flue dusts and similar materials from furnaces and the like which heretofore have been considered prohibitively difficult or expensive to agglomerate.

In many industrial and commercial operations it is desirable to agglomerate finely-divided particulate material, typically soluble to a substantial degree in water, into particles of larger size for further processing or for convenience in disposal. For example, in the manufacture of pellets and tablets for animal feed and pharmaceutical and other uses it is customary first to agglomerate the finely-divided or powdered and essentially water-soluble ingredients into granules, and then to compress or extrude those granules into tablets or pellets. Typically, such agglomeration or granulation is carried out batch-wise, in large containers, with the addition of water or other liquids and the aid of rotating impellers.

In other situations where it also would be desirable to agglomerate a finely-divided particulate material for convenience in disposal or for further processing, it heretofore has not been considered feasible to do so with conventional agglomeration techniques and apparatus. In many instances this is because the particulate material is essentially non-soluble or only very sparingly soluble in common liquids such as water. An example is the particulate matter exiting as flue dusts from steel-making furnaces and the like, which is extremely fine in particle size, and for that reason, difficult to handle or dispose of in its original condition. Such flue dusts oftentimes contain valuable constituents, such as derivatives of zinc and the like in significant concentrations, which it would be desirable to recover. Unfortunately, because of the need to agglomerate such dusts in order to process them for the recovery of their valuable ingredients, and because of the difficulty or expense involved in agglomerating them with conventional methods and apparatus, the recovery of such valuable ingredients heretofore frequently has not been technically and economically feasible.

2. Description of the Prior Art

One conventional process for the recovery of a metal such as zinc from waste materials involves the introduction of the zinc-bearing waste material into an inclined, rotating furnace or kiln, in which the zinc derivative is first reduced to elemental state by contact with carbonaceous material at elevated temperatures and then vaporized by heat from a countercurrent burning gas stream which conveys the zinc in vapor state out of the kiln for further processing. In order that the feed waste material itself not be blown out of the kiln, it must be of a minimum particle size. Thus, flue dusts such as the zinc-containing dusts previously referred to can not satisfactorily be processed in the kiln except through the agglomeration of the particulate waste material before it is introduced into the kiln. Such agglomeration, or pelletizing, heretofore has been achievable by spraying the finely-divided particulate material together with water onto a rapidly rotating circular disc or plate, and collecting the agglomerated particles that are discharged from the rotating plate. While satisfactory to a degree in terms of the agglomerated product, this latter method is too time-consuming and expensive to be considered generally suitable for the agglomeration of flue dusts such as zinc-containing dusts from electric steel-making furnaces.

SUMMARY OF THE INVENTION

It now has been found that flue dusts and similar finely-divided, substantially water-insoluble particulate materials can be suitably agglomerated, either for ease in handling or disposal or for further processing to recover valuable constituents, by introducing the particulate material together with a suitable binder such as water, in a suitable ratio, into a suitable blending means, specifically an operating screw conveying device of suitable configuration and orientation, and operating that conveyor in a manner such that the retention time of the mixture of binder and particulate material in progress from the conveyor's inlet to its outlet is sufficient to permit of the desired degree of agglomeration.

BRIEF DESCRIPTION OF THE DRAWINGS

In FIG. 1, the screw conveying means 10 is illustrated as conventional in general configuration, and as comprising impeller or screw 15 adapted for rotation within casing 11. Screw conveying means 10 is shown as inclined at a variable angle $\alpha$ with the horizontal plane. Impeller 15 comprises the continuous helical blade 16 rigidly mounted on shaft 17. The extremities of shaft 17 extend through the transverse ends of casing 11 and are shown as rotatably mounted in external bearings 18 and 19. Shaft 17 is rotated by drive means 20 through speed-variation means 21. Particulate material to be agglomerated is introduced through feed line 31, and the agglomerated product is removed through discharge line 33. Water or other suitable binder is introduced to conveying means 10 through line 32 and is controlled in rate of addition by valve means 35.

DETAILED DESCRIPTION OF THE INVENTION (INCLUDED PREFERRED EMBODIMENT)

Figure 1:
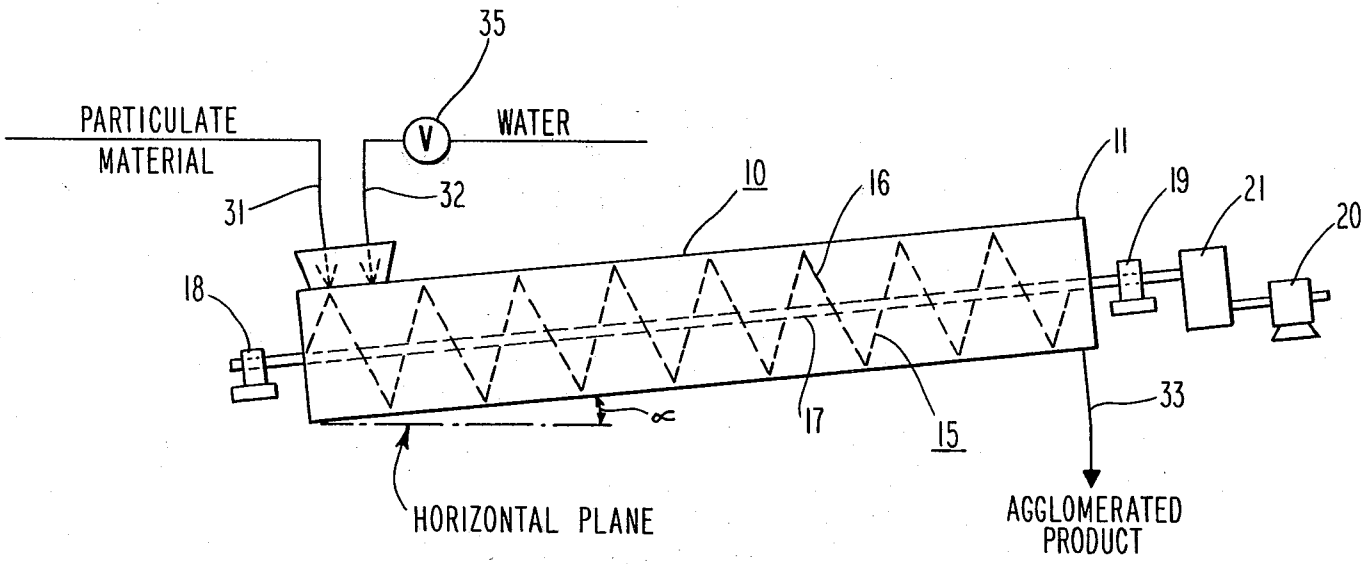
FIG. 1 is a schematic drawing of the process or method of the invention.

In accordance with the present invention a suitable amount of water or other suitable binder is mixed with the finely-divided particulate material, for example, the flue dust from an electric furnace used in steel-making, in a screw conveying device of suitable configuration and orientation, and the conveyor is operated in a manner such that the admixture remains in the operating conveyor for a period of time sufficient to produce the desired degree of agglomeration in the particulate material.

The water or other suitable binder may be added in any convenient way, such as by means of one or more streams and/or sprays. The ratio of the water or other binder to the solid material used is critical, and will depend upon the nature of the binder and the nature and particle size distribution of the solid material. A suitable ratio can be readily determined by simple experimentation. In the case of the flue dust produced in the operation of electric steel-making furnaces, such dust typically contains a substantial proportion (e.g., 35–40% by weight) of iron in both elemental and oxide forms, a similarly substantial proportion (e.g., 30–35% by weight) of zinc oxide, a significant if not substantial proportion (e.g., 10–15% by weight) of calcium oxide, smaller proportions (e.g., 1–5% by weight) of the oxides of manganese, magnesium, silicon, lead and aluminum, and trace proportions of other elements in oxide form. Typically, with respect to particle size distribution, more than 50 weight percent of such a material will pass through a standard 65 mesh screen, and more than 90 weight through a standard 28 mesh screen.

With such a flue dust as is described above, it has been found that water is a particularly suitable binder, and that a weight ratio of water to the solid particulate material in the range of from about 0.08 to about 0.12 gives satisfactory results and can be employed in the practice of the invention. A weight ratio of about 0.1 gives excellent results and is preferred. Other suitable binders include cement, bentonite and other aqueous solutions, such as solutions of sodium silicate and the like.

A screw conveying device of almost any configuration can be employed in the successful practice of this invention, provided it is appropriate in size for the amount of material to be processed and can be operated in a manner such that the mixture of particulate material and water can be retained in the operating conveyor for a suitable period of time, i.e., sufficient to provide the desired degree of agglomeration. For a conveyor of a determined length, inclination with the horizontal plane, and screw or impeller pitch, a suitable retention time normally can be achieved by controlling the speed of rotation of the screw or impeller. Alternatively, where variablility of the speed of rotation is necessarily or desirably limited, a suitable retention time can be achieved through variation of the pitch of the screw, the angle of inclination of the conveyor with the horizontal plane, and/or the length of the conveyor. In general, the retention time will be proportional to the conveyor (impeller) length and to the angle of upward inclination, and will be inversely proportional to the pitch of the screw and to the rotational speed of the screw. Typically, for a flue dust of the type defined hereinabove, retention times in the range of from about 15 to about 60 seconds are suitable and will provide satisfactory results, although a retention time of about 30 to 45 seconds is preferred.

In order to illustrate a specific embodiment of this invention, the effluent flue dust from an industrial electric steel-making furnace is periodically and systematically sampled and assayed, and continuously collected until a total of approximately 20 tons has been accumulated. The assays show average concentrations in the flue dust of about 37% by weight of iron in the form of elemental iron and iron oxide, about 33% by weight of zinc oxide, about 14% by weight of calcium oxide, concentrations of from about 1 to 5 weight percent of the oxides of manganese, magnesium, silicon, lead and aluminum, and trace concentrations of the oxides of other elements. An illustrative but typical screen analysis (particle size distribution) for this material is presented hereinafter in a comparison with the agglomerated product.

A conventional screw conveyor is provided, in which the screw or impeller has a pitch of 10 inches and a length of 9 feet. This screw is surrounded by a relatively loose-fitting (i.e., ¼ inch clearance) but semi-rigid neoprene casing which is open at the top. The screw is adapted by means of an air motor and a conventional drive mechanism to be rotated a fixed speed of 2200 revolutions per minute (r.p.m.). The conveyor casing and impeller assembly is inclined upwardly, from the feed end to the discharge end, at an angle of about 20° with the horizontal plane.

The flue dust above described is continuously introduced into the inlet end of the operating screw conveyor at a steady rate of about 1 cubic yard per minute, i.e. about 1485 pounds per minute. A stream of liquid water is continuously directed into the feed stream of flue dust as the latter enters the conveyor, the water being introduced at the steady rate of approximately 17 gallons per minute (g.p.m.), so as to provide a substantially constant weight ratio of water to flue dust of about 0.10. Due to the length, configuration, vertical inclination, and speed of the conveyor impeller, the retention time of the water and flue dust admixture in progress from the conveyor's inlet end to its outlet end is about 45 to 50 seconds. The effluent material from the conveyor is periodically and systematically assayed for particle size distribution. Illustrative but typical screen analyses (particle size distributions) for both the dry flue dust feed and the agglomerated flue dust product are as follows:

| | Particles Retained on Screen (weight percent) | |
|---|---|---|
| Screen Mesh Size | Dry Flue Dust | Agglomerated Flue Dust |
| ⅜ inch | — | 3.85 |
| No. 4 | — | 6.71 |
| 8 | — | 24.27 |
| 16 | — | 26.84 |
| 28 | 3.7 | 17.20 |
| 48 | 24.8 | 8.35 |
| 65 | 18.9 | 2.50 |
| 115 | 24.3 | 2.65 |
| 200 | 14.7 | 2.28 |
| through 200 | 12.5 | 5.35 |

As can be seen from the above comparison, practice of the method of the present invention with flue dusts of the types described results in a very substantial agglomeration of the particles of the flue dust. This agglomerated material has been found to be altogether suitable for processing by conventional methods to recover zinc and other valuable ingredients.

When the above-described flue dust is similarly processed in other screw conveyors of different lengths, inclinations and/or configurations, but operated at a speed such as to provide the same or a similarly suitable retention time, similar results are obtained. Likewise, when other finely-divided particulate materials are processed in accordance with this invention, similarly successful results are achieved.

The invention claimed is:

1. Method for agglomerating finely-divided particulate material in a steel-making furnace flue dust containing calcium oxide, said method comprising:

(a) Introducing said flue dust into the inlet end of an operating screw conveyor means comprising an upwardly-inclined casing, a helical impeller rotating within said casing and having a length of about 9 feet and a pitch of about 10 inches;

(b) Introducing water into said flue dust adjacent said inlet end and in an amount in the range of from about 8 to about 12 pounds per 100 pounds of dry flue dust introduced;

(c) Operating said conveyor impeller at a rotational speed in the range of from about 2000 to about 8000 revolutions per minute; and (d) Removing from said outlet end particulate material that is agglomerated at least in substantial part.

2. Method according to claim 1 wherein the rotation speed of said conveyor impeller is approximately 2200 revolutions per minute.

3. Method according to claim 1 wherein said upwardly-inclined casing is inclined upwardly from inlet end to outlet end at an angle of approximately 20° with the horizontal plane.

* * * * *